US006419878B2

(12) United States Patent
Yazawa et al.

(10) Patent No.: US 6,419,878 B2
(45) Date of Patent: Jul. 16, 2002

(54) FE-CR ALLOY HAVING EXCELLENT INITIAL RUST RESISTANCE, WORKABILITY AND WELDABILITY

(75) Inventors: Yoshihiro Yazawa; Takumi Ujiro; Susumu Satoh; Hiroki Ota, all of Chiba (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/867,422

(22) Filed: May 31, 2001

(51) Int. Cl.[7] ..... C22C 38/52; C22C 38/46

(52) U.S. Cl. ..... 420/37; 420/36; 420/69; 420/109

(58) Field of Search ..... 420/36, 37, 69, 420/109; 148/325, 333

(56) References Cited

FOREIGN PATENT DOCUMENTS

| | | |
|---|---|---|
| EP | 0 570 985 | 11/1993 |
| EP | 0 597 129 | 5/1994 |
| EP | 0 774 519 | 5/1997 |
| EP | 0 774 520 | 5/1997 |
| JP | 9-184049 | 7/1997 |
| JP | 9-291308 | 11/1997 |

*Primary Examiner*—Deborah Yee
(74) *Attorney, Agent, or Firm*—Young & Thompson

(57) ABSTRACT

Fe—Cr alloy having excellent weldability and initial rust resistance with no requirement of greatly increasing the amount of elements such as Ni, Cu, Cr or Mo, addition of Nb or Ti and, further, excess reduction of C and N, in which the Fe—Cr alloy containing Cr in an amount of more than about 8.0 mass % and less than about 15 mass % is controlled specifically for the ingredients to contain
Co: from about 0.01 mass % to about 0.5 mass %,
V: from about 0.01 mass % to about 0.5 mass % and
W: from about 0.001 mass % to about 0.05 mass %, and a value X represented by the following equation (1) and, preferably, a value Z represented by the following equation (2) satisfy: $X \leqq 11.0$, and $0.03 \leqq Z \leqq 1.5$ respectively:

$$X\ \text{value}=\text{Cr(mass \%)}+\text{Mo(mass \%)}+1.5\text{Si(mass \%)}+0.5\text{Nb(mass \%)}+0.2\text{V(mass \%)}+0.3\text{W(mass \%)}+8\text{Al(mass \%)}-\text{Ni(mass \%)}-0.6\text{Co(mass \%)}-0.5\text{Mn(mass \%)}-30\text{C(mass \%)}-30\text{N(mass \%)}-0.5\text{Cu(mass \%)} \quad (1)$$

$$Z\ \text{value}=(\text{Co(mass \%)}+1.5\text{V(mass \%)}+4.8\text{W(mass \%)}) \quad (2)$$

,and more preferably, C/N is controlled to be 0.6 or less.

16 Claims, 4 Drawing Sheets

FE-CR ALLOY HAVING EXCELLENT INITIAL RUST RESISTANCE, WORKABILITY AND WELDABILITY

FIELD OF THE INVENTION

This invention concerns a Fe—Cr alloy having excellent initial rust resistance, workability and weldability and, more particularly, a Fe—Cr alloy suitable for use in civil engineering and building structural materials requiring initial rust resistance, bending workability and toughness for weld zone.

DESCRIPTION OF THE RELATED ART

As civil engineering and building structural materials, carbon steels such as SS 400 (JIS G 3101,JIS is Japanese Industrial Standard,here in after JIS) and high tensile steels such as SM 490(JIS G 3106) and such steel materials applied with painting or plating have mainly been used.

However, as designs for the materials have been varied, use of various kinds of materials have been studied in recent years.

Among them, since Fe—Cr alloys which are excellent in corrosion resistance and aesthetic appearance scarcely require maintenance cost for rusting, they can be said to be highly attractive materials in view of life cycle cost (LCC).

Particularly, buildings constructed in coastal districts involve problems of short life and increased maintenance cost for suppressing corrosion. Further, also in view of the propagation for the water front development, the Fe—Cr alloys have been greatly expected as corrosion resistant functional materials for use in civil engineering and building structures excellent in corrosion resistance, weldability and, particularly, initial rusting resistance.

Fe—Cr alloys are generally classified in view of the metal structures into ferritic stainless steels represented by SUS 430 steels (JIS G 4304), martensitic stainless steels represented by SUS 410 steels (JIS G 4304) austenitic stainless steels represented by SUS 304(JIS G 4304), 2-phase stainless steels represented by SUS 329 steels (JIS G 4304) and precipitation hardened steels represented by SUS 630 (JIS G 4304).

Among various kinds of Fe—Cr alloys described above, austenitic stainless steels which have been actually used most frequently having material strength, corrosion resistance, easy weldability, toughness of weld zone and general applicability have been studied, particularly, so far as the materials for use in civil engineering and building structures.

Such austenitic stainless steels have characteristics fully satisfying the characteristics required for civil engineering and building materials such as strength, corrosion resistance, fire resistance and toughness of weld zone.

However, such austenitic stainless steels (1) contain a great amount of alloying elements such as Ni and Cr and, accordingly, are very expensive compared with carbon steels, (2) cause stress corrosion cracking, and (3) show greater heat expansion coefficient and relatively low heat conductivity compared with carbon steels, so that heat-affected strains upon welding tend to be accumulated and they are difficult to be used to materials requiring high accuracy. In view of the above, they involve a problem that it is difficult to apply them to the use of a general purpose structural materials in which carbon steels or carbon steels applied with painting or plating are used and their application range is restricted.

In view of the above, low Cr content alloy steels with the Cr content of 15 mass % or less have been studied recently for the application use to civil engineering and building materials as substitutes for plated or painted carbon steels. Application of the martensitic stainless steels in the field of the civil engineering and building materials is an example.

Since the Fe—Cr alloys with the Cr content of 15 mass % or less have less Cr content and, further, less Ni content compared with Ni-containing Fe—Cr—Ni alloys as described above, they have a feature of being outstandingly inexpensive and having low heat expansion coefficient and high heat conductivity, as well as excellent in corrosion resistance and high yield strength compared with carbon steels.

Further, the martensitic stainless steels are also advantageous in that they are free from the worry of σ embrittlement and 475° C. embrittlement that are the problem in high Cr alloys containing 15 mass % or more of Cr and, further, free from the worry of stress corrosion cracking in chloride containing circumstances that gives a problem in austenitic stainless steels.

However, since the martensitic stainless steels represented by SUS 410 steels have C content as high as about 0.1 mass %, they are poor in the toughness of weld zone and the workability of the weld zone and require pre-heating upon welding to deteriorate the welding operationability, they still leave a problem in the application use to those materials requiring welding.

As a countermeasure for the problems described above, Japanese Patent Publication No. 13463/1976 for example, proposes a martensitic stainless steel for use in welding structures, containing 10 to 18 mass % of Cr, 0.1 to 3.4 mass % of Ni, 1.0 mass % or less of Si and 4.0 mass % or less of Mn in which C is reduced to 0.030 mass % or less and N is reduced to 0.020 mass % or less and massive martensitic structure is formed in the heat-affect zone, thereby improving the performance of the weld zone.

Further, Japanese Patent Publication No. 28738/1982 proposes a martensitic stainless steel excellent in the toughness of weld zone and workability, requiring neither preheating nor post heating before and after the welding by incorporating 10 to 13.5 mass % of Cr, 0.5 mass % or less of Si and 1.0 to 3.5 mass % of Mn, reducing C to 0.020 mass % or less and N to 0.020 mass % or less and, further, strictly restricting Ni to less than 0.1 mass %.

However, the techniques disclosed in Japanese Patent Publication Nos. 13463/1976 and 28738/1982 involve a problem that no countermeasure is taken for the problem inherent to the civil engineering and building structural materials as shown below.

When considering the application use to the civil engineering and building structures, those members such as pillars or beams are not exposed to severe circumstances after the completion of structures as outer wall materials. However, they are sometimes left in the outdoor in a short period of time of about several months after worked into structural members such as steel pipes or steel shapes with various sections in factories and shipping therefrom till the completion of the constructing operation for the structures. Accordingly, it is important to improve the initial rust resistance of the steel materials for suppressing occurrence of initial rust caused during construction period after shipping in view of the appearance, as well as in view of the durability of the structures after completion.

Further, when they are used as the civil engineering and building structural materials, since the requirement for the surface property is not so strict, it is desirable with an economical point of view that they can be used as hot rolled or hot rolled and annealed in a state where scales are not removed from the surface of steel plates.

Further, considering fabrication, for example, to steel shapes having various sections, there are great demand for the improvement of the toughness of the steel plate, particularly, elongation and bending workability in base steel plates or weld zones.

In view of the problems described above, Japanese Patent Laid-Open No. 302796/1999 proposes a hot rolled stainless steel sheet for use in building structures of excellent corrosion resistance, as well as a manufacturing method thereof, the steel having compositional ingredients comprising:

C: 0.005 to 0.1 mass %,
Si: 0.05 to 1.5 mass %,
Mn: 0.05 to 1.5 mass %,
P: 0.04 mass % or less,
S: 0.05 mass % or less,
Cr: 10 to 15 mass % and
N: 0.055 mass % or less, reducing (C+N) to 0.1 mass % or less and containing one or two of Ni and Cu within a range from 0.1 mass % or more and less than 1.0 mass %, with the balance of Fe and inevitable impurities.

Further, Japanese Patent Laid-Open No. 302797/1999 proposes a hot rolled stainless steel sheet for use in building structures, of excellent corrosion resistance, as well as a manufacturing method thereof, the steel having compositional ingredients comprising:

C: 0.005 to 0.1 mass %,
Si: 0.05 to 1.5 mass %,
Mn: 0.05 to 1.5 mass %,
P: 0.04 mass % or less,
S: 0.05 mass % or less,
Cr: 10 to 15 mass % and
N: 0.055 mass % or less, reducing (C+N) to 0.1 mass % or less and, further, containing one or two of Ni and Cu within a range from 0.1 mass % or more and less than 1.0 mass % with the balance of Fe and inevitable impurities and in which the average Cr content per one $\mu$m in a surface metal layer of the hot rolled steel sheet is 7 mass % or more after mechanically peeling scales after hot rolling.

However, the techniques disclosed in Japanese Patent Laid-Open Nos. 302796/1999 and 302797/1999 merely utilize the technique of improving rust resistance by the addition of Ni and Cu, the effect of which has been known so far but gives no sufficient disclosure for the method of improving the initial rust resistance without deteriorating the toughness, particularly, the elongation and the bending workability in the base steel plate and the weld zone, and improvement therefor has been demanded.

In addition, as a method of improving the corrosion resistance, the weldability and the toughness of weld zone of the Fe—Cr alloys, since enhancement of the purity and, in addition, addition of Nb or Ti for fixing carbon or nitrogen as carbides or nitrides are effective, various steels produced by using such means have been developed.

For example, Japanese Patent Laid-Open No. 13060/1985 discloses a stainless steel intended for the improvement of corrosion resistance by adding Nb as a stabilizing agent for carbon and nitrogen in an appropriate amount and further shows that the corrosion resistance can be improved further by the addition of Mo, Ni and Cu.

However, there is no sufficient study on the technique of effectively improving the toughness of weld zone and particularly the initial rust resistance for the duration from shipping to construction, for in the application of building structural materials and it has been demanded to establish a further improved method in addition to the existent technique of adding alloying elements such as Cu, Ni, Mo, Ti and Nb or reducing C and N known so far as described above.

SUMMARY OF THE INVENTION

This invention has been developed in view of the foregoing situations and is directed to a Fe—Cr alloy having not only excellent weldability, corrosion resistance and workability but also excellent initial rust resistance.

A first aspect of this invention is a Fe—Cr alloy having excellent initial rust resistance, workability and weldability, and having a composition comprising:

C: more than about 0.0025 mass % and less than about 0.03 mass %,
N: more than about 0.0025 mass % and less than about 0.03 mass %,
Si: more than about 0.1 mass % and less than about 2.0 mass %,
Mn: more than about 0.1 mass % and less than about 3.0 mass %
Cr: more than about 8.0 mass % and less than about 15 mass %,
Al: less than about 0.5 mass %,
P: less than about 0.04 mass %,
S : less than about 0.03 mass %,
Ni: from about 0.01 mass % to about 3.0 mass %,
Co: from about 0.01 mass % to about 0.5 mass %,
V: from about 0.01 mass % to about 0.5 mass % and
W: from about 0.001 mass % to about 0.05 mass %, and a X value in the following equation (1), satisfies: $X \leqq 11.0$, the balance substantially being Fe and inevitable impurities.

$$\text{X value}=\text{Cr(mass \%)}+\text{Mo(mass \%)}+1.5\text{Si(mass \%)}+0.5\,\text{Nb(mass \%)}+0.2\text{V(mass \%)}+0.3\,\text{W(mass \%)}+8\,\text{Al(mass \%)}-\text{Ni(mass \%)}-0.6\,\text{Co(mass \%)}-0.5\,\text{Mn(mass \%)}-30\,\text{C(mass \%)}-30\,\text{N(mass \%)}-0.5\,\text{Cu(mass \%)} \quad (1)$$

A second aspect of this invention is a Fe—Cr alloy having excellent initial rust resistance, workability and weldability as defined in the first aspect described above and having a Z value shown by the following equation (2) can satisfy: $0.03 \leqq \text{Z value} \leqq 1.5$.

$$\text{Z value}=(\text{Co(mass \%)}+1.5\text{V(mass \%)}+4.8\,\text{W(mass \%)}) \quad (2)$$

A third aspect of this invention is a Fe—Cr alloy having excellent initial rust resistance, workability and weldability as defined in the first or second aspect described above and wherein $C/N \leqq 0.60$.

A fourth aspect of this invention is a Fe—Cr alloy having excellent initial rust resistance, workability and weldability as defined in the first, second or third aspect described above, wherein the alloy has a composition containing at least one element selected from:

Cu: from about 0.0001 mass % to about 3.0 mass % and
Mo: from about 0.0001 mass % to about 3.0 mass %.

A fifth aspect of this invention is a Fe—Cr alloy having excellent initial rust resistance, workability and weldability as defined in the first, second, third or fourth aspect described above, wherein the alloy has a composition containing at least one element selected from:

Ti: from about 0.0001 mass % to about 0.7 mass %,
Nb: from about 0.0001 mass % to about 0.7 mass %,
Ta: from about 0.0001 mass % to about 0.7 mass % and
Zr: from about 0.0001 mass % to about 0.5 mass %.

A sixth aspect of this invention is a Fe—Cr alloy having excellent initial rust resistance, workability and weldability as defined in the first, second, third, fourth or fifth aspect described above, wherein the alloy has a composition containing B: from about 0.0002 mass % to about 0.002 mass %.

DESCRIPTION OF THE PREFERRED EMBODIMENTS

The present inventors have made a detailed study on various kinds of elements for obtaining a Fe—Cr alloy excellent in weldability, corrosion resistance and workability, as well as also excellent in initial rust resistance. Particularly, effects on the weldability, the toughness of weld zone and the initial rust resistance in Fe—Cr alloys with the Cr content of less than 15 mass % were investigated taking notice on Co, V and W.

For reducing the sensitivity to cracking in the weld zone and ensuring toughness, initial rust resistance, ductility and workability of steel plates, studies have hither to been made mainly on the control of elements such as Cr, Mo and Ni and C, N, Nb and Ti in addition to optimization for the Ni equivalent (for example=Ni (mass %)+30 C(mass %)+0.5 Mn(mass %)) and the Cr equiralent (for example=Cr bx;1 (mass %)+Mo(mass %)+1.5 Si(mass %)+0.5 Nb(mass %)).

However, regarding Co, V and W, while they give effect on the initial rust resistance and stability in the ferritic phase (α-phase) and austenitic phase (γ-phase), no close study has been made for the effects on the Cr equivalent and the Ni equivalent and the effect on the initial rusting of the weld zone and the base metal with scales on its surface.

In this invention, effects of such elements on the stability of the phase are considered and, particularly, effects of Co, V and W on the initial rust resistance near the weld zone or on the initial rust resistance of steel plates with scales have been investigated specifically, to thereby quantitatively evaluate the effect of such elements on the toughness and the initial rust resistance and determine an optimal range and the optimal ratio of such elements.

Figure 1:
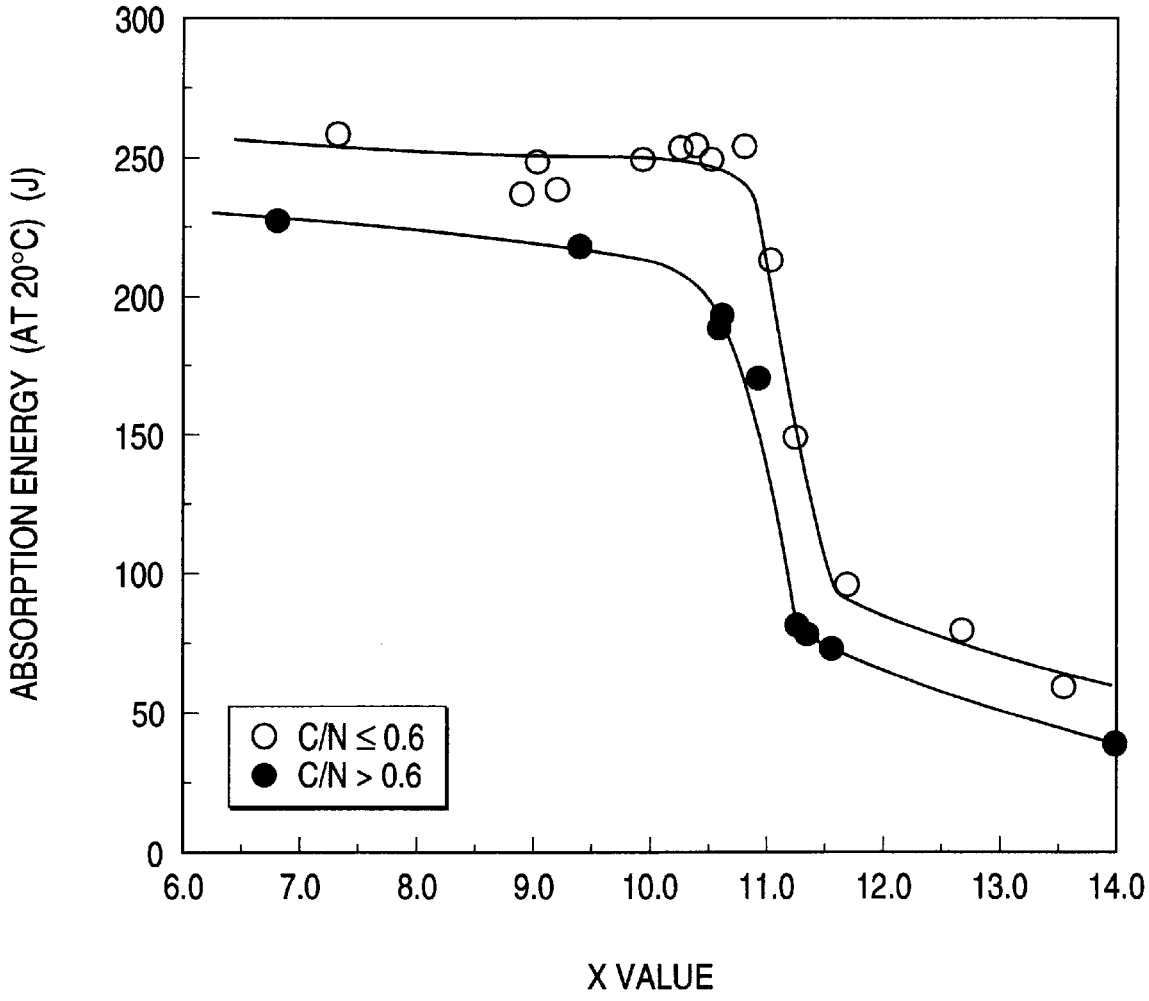
FIG. 1 is a graph showing a relation between the X value and the toughness of weld zone (absorption energy in a Charpy impact test)

That is, it has been found that it is possible to evaluate the effects of Co, V and W on the stabilization of the austenitic phase and on the toughness of weld zone by using the X value represented by the following equation (1):

$$\text{X value}=\text{Cr(mass \%)}+\text{Mo(mass \%)}+1.5\ \text{Si(mass \%)}+0.5\ \text{Nb(mass \%)}+0.2\text{V(mass \%)}+0.3\text{W(mass \%)}+8\ \text{Al(mass \%)}-\text{Ni(mass \%)}-0.6\ \text{Co(mass \%)}-0.5\ \text{Mn(mass \%)}-30\ \text{C(mass \%)}-30\ \text{N(mass \%)}-0.5\ \text{Cu(mass \%)} \quad (1)$$

and the welding heat-affected zone is substantially transformed into a martensitic structure and the toughness of weld zone can be improved by controlling the ingredients for the alloy such that the X value can satisfy a predetermined range. FIG. 1 shows an example of the result of experiment leading to the finding, that is a result of examination for the relation between the X value and the toughness of weld zone (absorption energy in the Charpy impact test). As shown in the graph, the toughness of the weld zone is improved outstandingly by defining the X-value as 11.0 or less.

Figure 2:
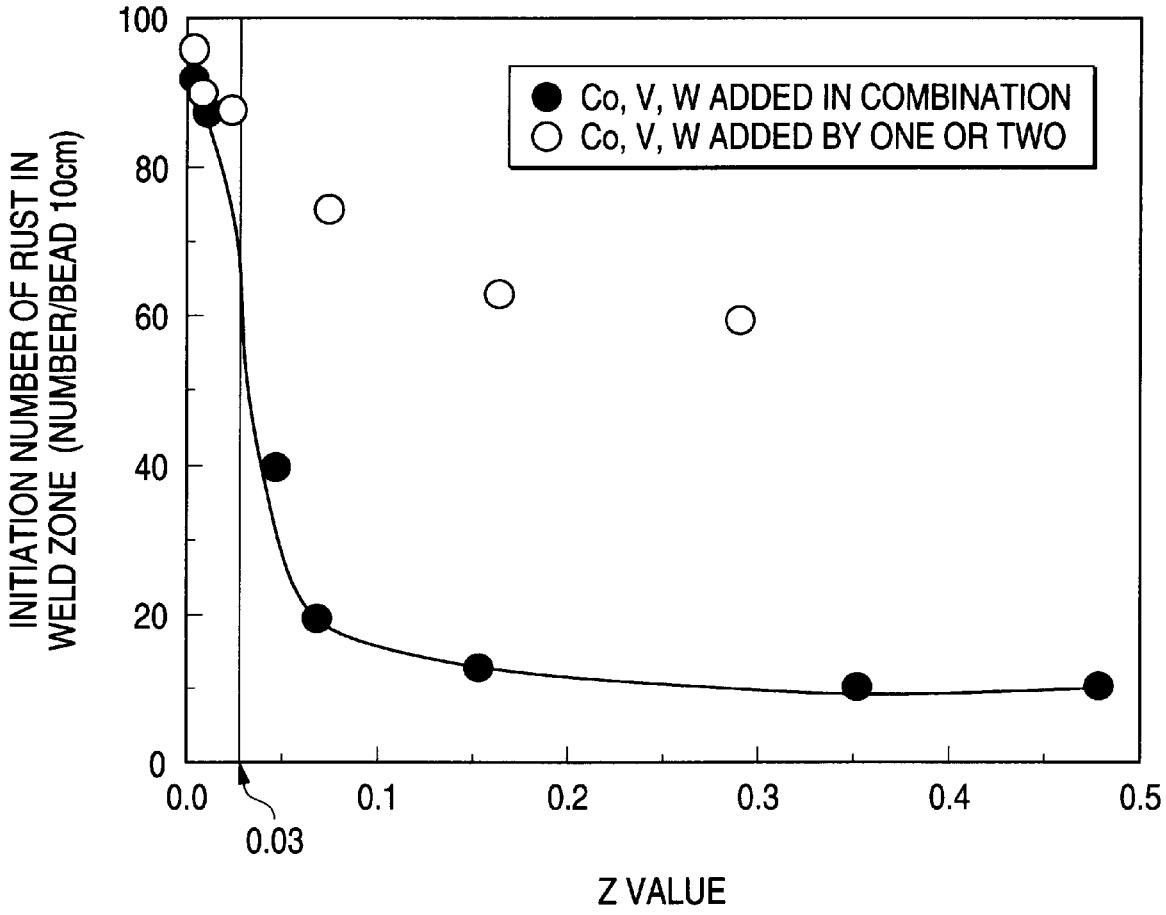
FIG. 2 is a graph showing a relation between Z value and the number of initiation points of rust of weld zone.
Figure 3:
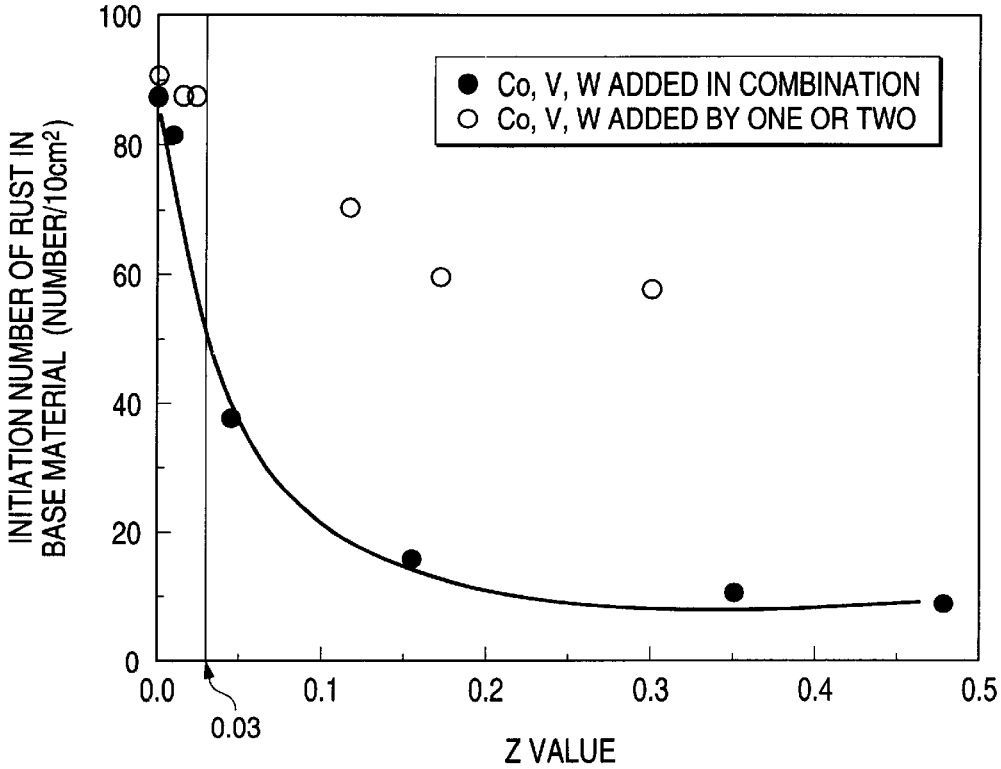
FIG. 3 is a graph showing a relation between Z value and the number of initiation points of rust of the base steel plate with scales.

Further, when the effects of Co, V and W on the initial rust resistance of weld zone and the scale-remaining steel plate have been examined with respect to the Z value represented by the following equation (2):

$$\text{Z value}=(\text{Co(mass \%)}+1.5\text{V(mass \%)}+4.8\text{W(mass \%)}) \quad (2)$$

it has been found that the corrosion resistance, particularly, the initial rust resistance and the workability can be improved in a good balanced without deteriorating the toughness of weld zone by controlling the alloy ingredients so as to satisfy the equation (2) to within the predominant range, in addition to the adjustment of the X value shown by the equation (1) to the predetermined range. FIG. 2 and FIG. 3 show examples of the result of experiment leading to the finding of this invention which show the result of examination on a relation between the number of initiation points of rust in the weld zone, that of the scale-remaining steel plate and the Z value, respectively. As shown in the graph, it can be seen that the number of initiation points of rust is abruptly decreased to improve the initial rust resistance when Z value is 0.03 or more.

Figure 4:
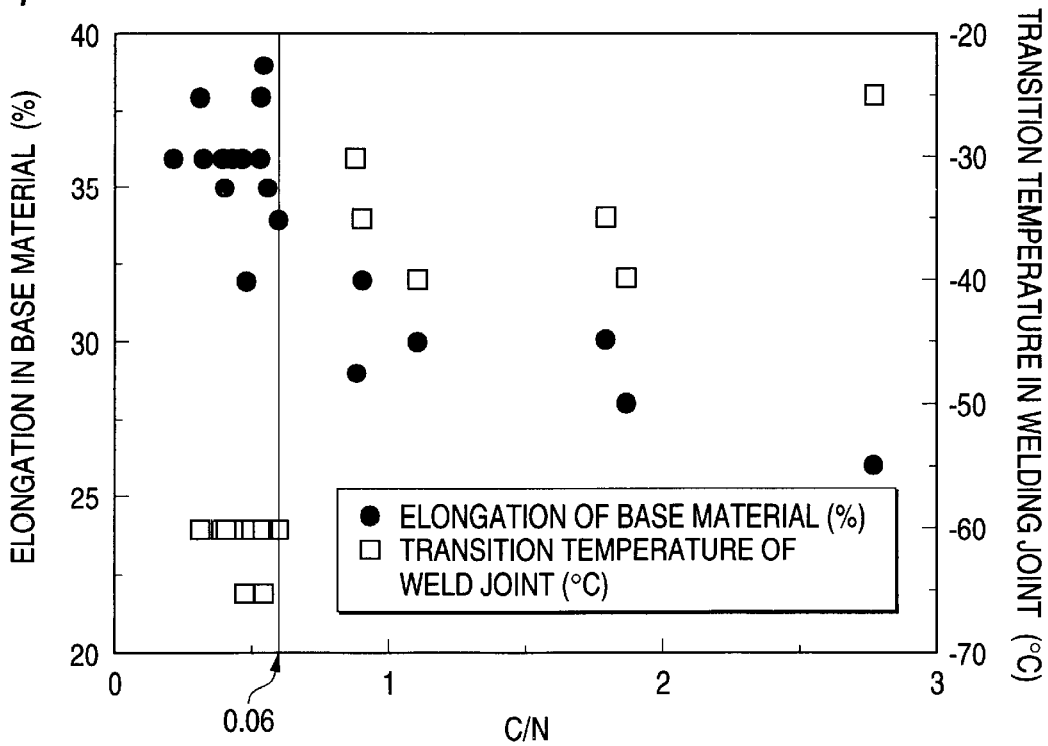
FIG. 4 is a graph showing a relation between C/N, and the elongation of the base steel plate and the transition temperature of the weld zone.

Further, for the steels controlled for the ingredients as described above, a study has been made while taking notice on C and N with an aim of improving the ductility and the workability of weld zone and the base steel plate. FIG. 1 shows a relation between the X value and the toughness of the weld zone in a case where C/N is 0.6 or less and a case where C/N exceeds 0.6. Further, FIG. 4 shows a relation between the C/N, and the elongation of the base metal steel plate and the transition temperature determined from the result of the Charpy impact test for the weld zone (temperature where a certain particular absorption energy is obtained which is an one-half value of the absorption energy at a temperature where the percent ductility fracture of 100% is obtained). It can be seen that toughness of weld zone is further improved and the ductility (elongation) of the base steel plate is improved and the workability is improved by controlling the C/N value to 0.6 or less. Further, as shown in the embodiment section, the toughness of the base steel plate is also improved by controlling C/N.

This invention is based on the findings described above. Thus, it has been found that the toughness of the weld zone can be ensured and the initial rust resistance in the weld zone and the scale-remaining steel plate and the workability in the weld zone can be improved effectively in a good balance, without adding expensive Ni, Cu, Cr, Mo or the like in an extremely great amount, adding Nb and Ti and, further, without extremely reducing the amount of C and N, which is an important feature of this invention.

This invention is to be explained concretely.

At first, the reasons for defining the ingredients in the composition of the alloy to the range described above in this invention are to be explained.

C: More than about 0.0025 mass % and less than about 0.03 mass %,

N: More than about 0.0025 mass % and less than about 0.03 mass %

For the improvement of the toughness and the workability in the welding heat-affected zone and prevention of weld cracking, reduction of C and N is effective as known so far. Further, since C and N not only give a significant effect on the hardness of the martensitic phase but also deteriorate the corrosion resistance due to formation of Cr depletion zone along with precipitation of carbonitrides, the upper limit for each of the C and N is defined as less than about 0.03 mass %. However, in the compositional range of the steel according to this invention, while the reduction of C and N is effective for the improvement of the weld zone characteristic, and the workability and the corrosion resistance, excess reduction of them imposes increased load on refining, as well as softens the martensitic phase along with reduction of C and N, making it difficult to ensure a martensitic structure to deteriorates the toughness of weld zone by the formation of coarse ferritic grains, so that each of C and N is incorporated by more than about 0.0025 mass %.

A particularly preferred compositional range is from about 0.005 to about 0.02 mass % both for C and N.

Si: More than about 0.1 mass % and less than about 2.0 mass %

Si is a useful element as a deoxidizer. Since no sufficient deoxidizing effect can be obtained when the content is 0.1 mass % or less and, on the other hand, excessive addition of 2.0 mass % or more deteriorates the toughness and the workability, the Si content is defined within a region of more than 0.1 mass % and less than 2.0 mass %.

A particularly preferred range is from about 0.03 to about 0.5 mass %.

Mn: more than about 0.1 mass % and less than about 3.0 mass %

Mn is an element for stabilizing the austenitic phase (γ-phase) and effectively contributes to the improvement of the toughness of weld zone by transforming the welding heat-affected zone structure into a martensitic structure. Further, since Mn is useful also as a deoxidizing agent like Si, it is incorporated in an amount of more than about 0.1 mass %. However, since excess addition deteriorates the workability and the corrosion resistance by formation of MnS, it is defined to less than about 3.0 mass %.

A particularly preferred range is from more than 0.1 mass % and 1.5 mass % or less.

Cr: more than about 8 mass % and less than about 15 mass %

Cr is an element effective for the improvement of the corrosion resistance but it is difficult to ensure a sufficient corrosion resistance when it is 8 mass % or less. Further, Cr is an element for stabilizing the ferritic phase (α-phase) but addition by 15 mass % or more not only deteriorates the workability but also lowers the stability of the austenitic phase (γ-phase), and a sufficient amount of the martensitic phase can no more be ensured upon welding to lower the strength and the toughness of weld zone.

Accordingly, Cr is contained within a range more than about 8 mass % and less than about 15 mass % in this invention. Further, a particularly preferred range for providing rust resistance, workability and weldability is from about 9.0 to about 13.5 mass %.

Al: less than about 0.5 mass %

Al is not only useful as a deoxidizing agent but also contributes effectively to the improvement of the toughness of weld zone. Since the amount of inclusions is increased to deteriorate mechanical properties when the content is 0.5 mass % or more, Al is restricted to less than about 0.5 mass %.

It is not always necessary to incorporate Al.

P: less than about 0.04 mass %

P is an element not only deteriorating the hot workability, formability and toughness but also deleterious to the corrosion resistance. Since the effect becomes conspicuous when the P content is 0.04 mass % or more, the content is restricted to less than about 0.04 mass %.

More preferably, it is about 0.025 mass % or less.

S: less than about 0.03 mass %

S is bonded with Mn to form MnS as initial rust initiation points. Further, since S is also a deleterious element of segregating at the crystal grain boundary to promote brittlement of the grain boundary, it is preferably reduced as much as possible. Particularly, since the undesired effect becomes remarkable when the content is 0.03 mass % or more, the S content is restricted to less than about 0.03 mass %.

More preferably, it is about 0.006 mass % or less.

Ni: from about 0.01 mass % to about 3.0 mass %

Ni is an element for improving the ductility and toughness and it is added, particularly, for improving the toughness in the welding heat-affected zone, as well as improving the rusting resistance in this invention. However, when the content is less than 0.01 mass %, the addition effect is insufficient and, on the other hand, when it is 3.0 mass % or more, the effect is saturated and it causes disadvantageous hardening of the material, so that the Ni content is restricted within a range of 0.01 mass % or more and less than 3.0 mass %.

Co: from about 0.01 mass % to about 0.5 mass %,

V : from about 0.01 mass % to about 0.5 mass %,

W : from about 0.001 mass % to about 0.05 mass %

Co, V and W are particularly important elements in this invention.

The lower limits for the addition amounts of Co, V and W are defined, respectively, as 0.01 mass %, 0.01 mass % and 0.001 mass %. This is because no effect by the combined addition can be obtained when each of the contents is lower than the lower limit even when the X value or the Z value can satisfy the appropriate range. On the other hand, referring to the upper limit, V and W are defined as less than 0.5 mass % and less than 0.05 mass % respectively, since the material is remarkably hardened by the precipitation of carbides when they exceeds 0.5 mass % and 0.05 mass % respectively. Further, also referring to Co, since addition of 0.5 mass % or more results in hardening of the steel, it is restricted to less than 0.5 mass %.

Preferred ranges of the elements, while depending on the X value and the Z value, are Co: about 0.03 to about 0.2 mass %, V: about 0.05 to about 0.2 mass % and W: about 0.005 to about 0.02 mass %, respectively.

$$\text{X value}=\text{Cr(mass \%)}+\text{Mo(mass \%)}+1.5\ \text{Si(mass \%)}+0.5\ \text{Nb(mass \%)}+0.2\text{V(mass \%)}+0.3\text{W(mass \%)}+8\ \text{Al(mass \%)}-\text{Ni(mass \%)}-0.6\ \text{Co(mass \%)}-0.5\ \text{Mn(mass \%)}-30\ \text{C(mass \%)}-30\ \text{N(mass \%)}-0.5\ \text{Cu(mass \%)}:11.0\text{ or less.}$$

The X value is one of most important parameters in this invention. The X value is an index for evaluating the effect of each elements on the stability of the austenitic phase and this can properly evaluate the effects of the Co, V and W which are important in this invention. When the value is controlled to 11.0 or less, the welding heat-affected zone is transformed substantially to the martensitic structure to improve the toughness of the weld zone.

When steel plates of the thickness of 8.0 mm or more are also taken into consideration, it is further preferred to define the X value to 10.7 or less in order to ensure the stability of the austenitic phase in the weld zone.

$$\text{Z value}=(\text{Co(mass \%)}+1.5\text{V(mass \%)}+4.8\text{W(mass \%)}):0.03\text{ or more and }1.5\text{ or less}$$

Further, in this invention, the effect by the combined addition of Co, V and W is optimized by controlling the Z value within a range of 0.03 to 1.5.

The Z value is an index for the initial rust resistance of the weld zone and the scale-remaining steel plate. If the value is less than 0.03 or even one of the elements is not present, no sufficient initial rust resistance can be obtained for the weld zone and the base steel plate with oxide scales on its surface. On the contrary, even when the three elements are added in combination, if the Z value exceeds 1.5, their effects become saturated, as well as the material is hardened to remarkably deteriorate the workability. Accordingly, the three elements are essentially added and the Z value is restricted to a range from 0.03 to 1.5. A preferred range for the Z value also in view of the workability is from 0.2 to 0.6.

The mechanism of improving the initial rust resistance by the combined addition of the three elements Co, V and W is not apparent but it may be considered that Co, V and W concentrated near the surface of the steel plate or in the scale act effectively and give an effects, particularly, on the formation of carbonitrides, scale structure and, further, diffusion of Cr, thereby improving the initial rusting resistance by suppressing the formation of the Cr-depletion layer or by enchancing the densification of the scale structure.

C/N: 0.6 or less

The ductility and the toughness of the weld zone and the base steel plate are further improved by defining the C and N ratio to 0.6 or less in addition to the control for the ingredients described above.

While the details for the mechanism of improving the ductility and the toughness by the C/N control are not apparent, it may be considered to be concerned with the change of the ratio of the amount and the type of precipitation of (Fe, Cr) carbonitrides, specifically, $(Fe, Cr)_{23}C_6$, $(Fe, Cr)_7C_3$, $(Fe, Cr)_3C$, $(Fe, Cr)_2N$ and (Fe, Cr)N, and it can be assumed that the improving effect becomes remarkable in a case where the amount of the nitrides is increased compared with the amount of the carbides. Thus, favorable bending workability can be obtained in the steel plate in which the precipitation of carbonitrides is controlled and the elongation is improved.

In this invention, various kinds of elements to be described later can further be incorporated optionally.

Cu: from about 0.0001 mass % to about 3.0 mass %

Cu not only improves the corrosion resistance but also forms an austenitic phase to suppress grain growth in the welding heat-affected zone and effectively contribute to the improvement of the toughness of weld zone. However, when the content is 3.0 mass % or more, sensitivity to hot cracking is increased to possibly cause embrittlement, so that it is restricted to less than 3.0 mass %. On the other hand, with addition of less than 0.0001 mass %, the effect of improving the corrosion resistance is poor.

More preferably, the lower limit is defined as 0.01 mass % where the effect for improving the corrosion resistance develops and the upper limit is defined as 1.0 mass % in view of hot cracking.

Mo: from about 0.0001 mass % to about 3.0 mass %

Mo is also an element effective to improve the corrosion resistance. However, when it is added by 3.0 mass % or more, the X value increase to lower the stability of the austenitic phase, where remarkable deterioration is observed for the toughness and the workability, so that it is restricted to less than 3.0 mass %. On the other hand, when it added by less than 0.0001 mass %, the effect of improving the corrosion resistance is poor.

In view of the balance in the corrosion resistance and the workability, a range from about 0.01 to about 0.5 mass % is preferred.

Nb: from about 0.0001 mass % to about 0.7 mass %,

Ti: from about 0.0001 mass % to about 0.7 mass %,

Ta: from about 0.0001 mass % to about 0.7 mass %,

Zr: from about 0.0001 mass % to about 0.5 mass %

Each of Ti, Nb, Ta and Zr is a carbide forming element, which suppresses the grain boundary precipitation of Cr carbides upon welding or heat treatment to effectively improve the corrosion resistance. Further, Ti is also effective to improve hardenability. However, since the material is remarkably hardened when each of Ti, Nb and Ta is 0.7 mass % or more and Zr is 0.5 mass % or more, they were respectively defined as less than 0.7 mass % and less than 0.5 mass %. A more preferred range for each of them is from about 0.001 to about 0.3 mass %.

B: from about 0.0002 mass % to about 0.002 mass %

B is also an element effective to improve the steel hardenability. However, when the content is less than 0.0002 mass % the addition effect is poor, whereas when it exceeds 0.002 mass %, the material is rather hardened to deteriorate the toughness and the workability, so that it is restricted from about 0.0002 to about 0.002 mass %. It is preferably from about 0.0005 to about 0.001 mass %.

A preferred method of manufacturing the Fe—Cr alloy according to this invention is set forth below.

At first, after preparing molten steels controlled to the preferred composition of ingredients as described above by melting in a usually known melting furnace such as a converter furnace or an electric furnace, they are refined by a known refining method such as a vacuum degasing method (RH method), a VOD method (Vacuum Oxygen Decarburization) an AOD method (Argon Oxygen Decarburization) or the like and then cast into slabs by a continuous casting or an ingot making-blooming method, to form steel materials.

The steel materials are then heated and rolled into hot rolled steel strips (bands) or plates by a hot rolling step. There is no particular restriction on the heating temperature in the hot rolling step but, since excessively high heating temperature results in growing of crystal grains to deteriorate the toughness and the workability, the heating temperature is preferably 1300° C. or lower. Further, while there is no particular restrictions on the hot rolling conditions providing that hot rolled steel plates of a desired thickness can be obtained in the hot rolling step, the finishing temperature for the hot rolling is preferably 700° C. or higher for ensuring strength and toughness. However, when good workability or ductility and, further, favorable surface property are required, the finishing delivery temperature in the hot rolling is preferably from about 820° C. to about 1000° C.

Further, the coiling temperature is preferably 680° C. or lower in a case of carrying out tempering or annealing and, preferably, from about 690 to about 750° C. in a case of leaving out tempering or annealing.

After completing the hot rolling, annealing is preferably applied for those hot rolled plates having a hard structure formed into a martensitic phase, in order to soften the martensitic phase by tempering. The hot rolled plate annealing is preferably conducted at an annealing temperature of about 650° C. to about 750° C., for retention time from about 3 to about 20 hours in view of softening, as well as improvement for the workability and ensurance of the ductility.

After annealing the hot rolled plates, they are more preferably cooled gradually in a temperature range from 600 to 730° C. at a cooling rate of 50° C./h or less in view of softening.

Further, the steel plates after hot rolling or after hot rolling and annealing may be formed into plate products in a state of removing scales optionally by shot blasting and/or pickling, or further conditioned to a desired surface property by polishing or the like. If necessary, an anti-rusting paint or the like may also be coated.

The steel plates according to this invention can be fabricated into shapes with various sections by welding and bending.

Further, the steels with the above-mentioned ingredients according to this invention are applicable to various steel materials such as thick steel plates, steel shapes manufactured by hot rolling or bar steels that can be utilized in civil engineering and building fields.

Embodiments

Molten steels having compositions with ingredients shown in Tables 1, 2 and 3 were prepared by melting in a converter furnace—secondary refining step and formed into slabs by a continuous casting method. After re-heating the slabs up to 1200° C. again, they were subjected to 6-pass rough rolling at a draft in the final pass of the rough rolling of 30 to 45% and then to 7-pass finish rolling at a finish delivering temperature of 840 to 990° C., to form a hot rolled steel plates of 4.0 mm thickness. Further, hot rolled steel plates of various thickness such as of 2.0, 5.0, 8.0 and 12.0 mm were also manufactured for use in Charpy impact test and bending test for weld zone.

After applying hot rolled plate annealing to the hot rolled steel plates, descaling was conducted by shot blasting and pickling and then tensile test, impact test, bending test and corrosion resistance test were conducted. For a portion of samples, the corrosion resistant test was conducted without applying the descaling treatment and the initial rust resistance in the scale-remaining state was evaluated.

The hot rolled plate annealing was applied by keeping the plates at 670° C. for 10 hours and then gradually cooling down them to 200° C. (average cooling rate: 10° C./h)

For the tensile test specimen, JIS No. 13 B test specimens (JIS Z 2201) were sampled from steel plates of 4.0 mm thickness such that the tensile direction is parallel to the rolling direction and served for the test.

Further, from the steel plates of each thickness described above, weld joints were prepared by a semi-automatic MIG welder by using a 1.2 mmϕ welding wire of Y309 type or Y309L type(JIS Z 3321), and hardness test, impact test and bending test for the weld zone were conducted to evaluate the toughness, workability and corrosion resistance of the weld zone.

Welding was conducted by 1 pass welding under the welding conditions of an atmospheric gas of 100% Ar (flow rate: 20 l/min), (20% $CO_2$+80% Ar) (flow rate: 20 l/min) or 100% $CO_2$ (flow rate: 11 l/min), at a voltage of 20 to 30 V, with a current of 200 to 280 A, and at a welding speed of 1 to 20 mm/s. The welding direction was in the direction perpendicular to the rolling direction in the hot rolling.

Among the thus obtained weld joints, hardness test pieces and sub-sized Charpy impact test pieces according to JIS Z 2202 were sampled from 5.0 mm thick material (thickness: 10 mm, width: 5.0 mm, length: 55 mm).

Figure 5:
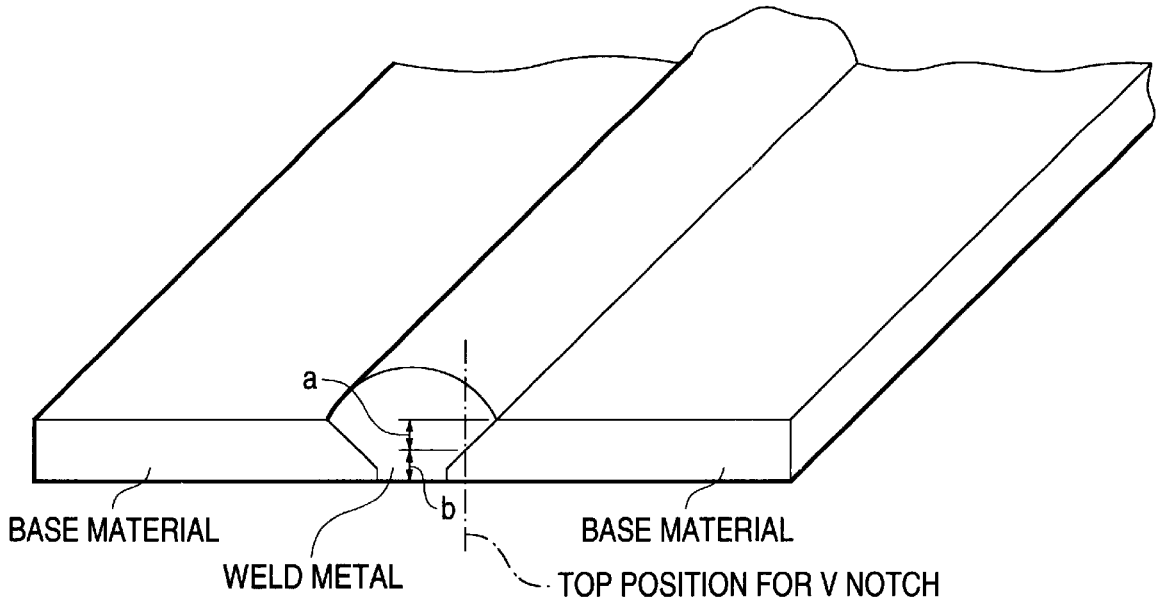
FIG. 5 is a view showing a positional relation between the top end position of a V notch and the weld zone of a Charpy impact value test specimen.

The notch in the impact test specimen was formed as a 2 mm V notch penetrating in the lateral direction of the test piece (5.0 mm: in the direction of the thickness of steel plate) and it was sampled, as shown in FIG. 5, from a cross bond portion (at a position where the weld metal portion and the welding heat-affected zone ratio a:b is 1:1 on both sides of a fusion line). Further, for the bending test specimens, a surface bending test specimen and a rear face test specimen according to JIS Z 3122 (thickness: steel plate thickness, width: 40 mm, length: 200 mm) were sampled after removing the reinforcement of weld and root bead from the weld zone. JIS specifies the test specimen thickness to 10 mm in a case where the plate thickness exceed 10 mm, but no thickness reduction was conducted for 12.0 mm thick material and the thickness of the test specimen was determined as 12.0 mm. In the bending test, after conducting a 180° bending test while setting the radius of bending R to R=1.0 t (t: steel plate thickness) as a severer condition than JIS Z 3122, the surface was observed by using a magnifier and the bending workability of the weld zone was evaluated in accordance with presence of cracking (x) or absence of cracking (O).

Further, as the initial rust resistance test, 6 hour's spray test with 3.5 mass % NaCl (30° C.) was conducted to steel plates of 4.0 mm thickness (annealed and pickled material, scale-remaining material and weld joint). The specimens after the test were evaluated by measuring the number of rust initiation points and the depth of holes after removing rusts by dipping into a diammonium citrate solution (60° C.) and by brush cleaning. The weld zone was evaluated by the initiation points of rust formed in the welding heat-affected zone by the number of initiation points per bead unit length (Number/bead 10 cm) and the depth thereof (for maximum 10 points in average).

The results are arranged and shown in Tables 4, 5 and 6.

As shown in Tables 4 and 6, all of examples of the invention satisfying the range for the ingredients of the composition according to this invention have excellent tensile characteristic and impact resistant toughness in the state of the hot rolled and annealed plate, as well as have excellent weld zone toughness, workability and corrosion resistance also for the weld joint. Further, in the steels controlled with the C/N ratio to 0.6 or less, elongation and the toughness of the base material, as well as the toughness and the bending workability of the weld zone are further improved compared with the case in which C/N is more than 0.6.

Further, as shown in Table 5, in the examples of the invention, since the number of initiation points of rust is small and the depth of the corrosion pit is small at the surface of the scale-remaining base steel plate as well as in the weld zone, it can be seen that they have excellent initial rust resistance.

As described above, by optimizing the alloy ingredients in accordance with this invention, an Fe—Cr alloy excellent in the weldability, the toughness of weld zone and the workability, as well as excellent in the initial rust resistance can be obtained.

Further, this invention can greatly extend the applicable range of the inexpensive Fe—Cr alloys including the application use for civil engineering and construction structural materials, and the industrial worth of the invention can be said extremely high in view of the life cycle cost.

TABLE I

| No. | Composition for ingredients (mass %) | | | | | | | | | | | | | | | | | | |
|---|---|---|---|---|---|---|---|---|---|---|---|---|---|---|---|---|---|---|---|
| | C | Si | Mn | P | S | Cr | Mo | Ni | Cu | N | Ti | Al | Ta | Zr | Nb | B | V | Co | W |
| 1 | 0.0100 | 0.20 | 0.83 | 0.020 | 0.005 | 8.10 | <0.001 | 0.50 | <0.01 | 0.0120 | <0.001 | 0.010 | <0.001 | <0.001 | <0.001 | <0.0001 | 0.051 | 0.050 | 0.0050 |
| 2 | 0.0120 | 0.11 | 0.79 | 0.020 | 0.004 | 10.77 | <0.001 | 0.50 | <0.01 | 0.0122 | <0.001 | 0.010 | <0.001 | <0.001 | <0.001 | <0.0001 | 0.051 | 0.051 | 0.0050 |
| 3 | 0.0080 | 0.18 | 0.80 | 0.020 | 0.005 | 11.77 | <0.001 | 0.50 | <0.01 | 0.0125 | <0.001 | 0.010 | <0.001 | <0.001 | <0.001 | <0.0001 | 0.040 | 0.050 | 0.0041 |
| 4 | 0.0074 | 0.20 | 0.90 | 0.024 | 0.005 | 12.33 | <0.001 | 0.50 | <0.01 | 0.0090 | <0.001 | 0.010 | <0.001 | <0.001 | <0.001 | <0.0001 | 0.010 | 0.050 | 0.0049 |
| 5 | 0.0090 | 0.19 | 0.79 | 0.022 | 0.005 | 13.60 | <0.001 | 0.50 | <0.01 | 0.0096 | <0.001 | 0.009 | <0.001 | <0.001 | <0.001 | <0.0001 | 0.011 | 0.050 | 0.0050 |
| 6 | 0.0095 | 0.20 | 0.66 | 0.031 | 0.005 | 15.22 | <0.001 | 0.54 | <0.01 | 0.0024 | <0.001 | 0.010 | <0.001 | <0.001 | <0.001 | <0.0001 | 0.010 | 0.050 | 0.0051 |
| 7 | 0.0278 | 0.13 | 1.25 | 0.008 | 0.001 | 8.14 | <0.001 | 1.00 | 0.01 | 0.0271 | <0.001 | 0.250 | <0.001 | <0.001 | <0.001 | <0.0001 | 0.030 | 0.249 | 0.0020 |
| 8 | 0.0028 | 0.11 | 2.01 | 0.038 | 0.029 | 14.91 | 0.010 | 2.95 | 2.98 | 0.0028 | <0.001 | <0.001 | <0.001 | <0.001 | <0.001 | <0.0001 | 0.020 | 0.050 | 0.0100 |
| 9 | 0.0099 | 0.20 | 0.80 | 0.020 | 0.005 | 11.70 | <0.001 | 0.50 | 0.05 | 0.0101 | <0.001 | 0.010 | <0.001 | <0.001 | <0.001 | <0.0001 | 0.009 | 0.009 | 0.0004 |
| 10 | 0.0098 | 0.19 | 0.79 | 0.020 | 0.029 | 11.50 | <0.001 | 0.50 | 0.05 | 0.0110 | <0.001 | 0.008 | <0.001 | <0.001 | <0.001 | <0.0001 | 0.015 | 0.015 | 0.0015 |
| 11 | 0.0145 | 0.18 | 0.80 | 0.020 | 0.005 | 11.50 | <0.001 | 0.50 | 0.04 | 0.0050 | <0.001 | 0.008 | <0.001 | <0.001 | <0.001 | <0.0001 | 0.032 | 0.080 | 0.0050 |
| 12 | 0.0151 | 0.11 | 0.91 | 0.020 | 0.005 | 11.80 | <0.001 | 0.50 | 0.05 | 0.0111 | <0.001 | 0.010 | <0.001 | <0.001 | <0.001 | <0.0001 | 0.088 | 0.099 | 0.0250 |
| 13 | 0.0133 | 0.20 | 0.80 | 0.020 | 0.005 | 11.58 | <0.001 | 0.50 | 0.06 | 0.0138 | <0.001 | 0.009 | <0.001 | <0.001 | <0.001 | <0.0001 | 0.300 | 0.280 | 0.0120 |
| 14 | 0.0180 | 0.80 | 1.40 | 0.020 | 0.005 | 11.80 | 0.003 | 0.50 | 0.05 | 0.0080 | <0.001 | 0.010 | <0.001 | <0.001 | <0.001 | <0.0001 | 0.610 | 0.510 | 0.0503 |
| 15 | 0.0178 | 0.80 | 0.99 | 0.020 | 0.005 | 11.60 | 0.002 | 0.48 | 0.05 | 0.0080 | <0.001 | 0.010 | <0.001 | <0.001 | <0.001 | <0.0001 | 0.770 | 0.330 | 0.0800 |
| 16 | 0.0130 | 1.20 | 0.80 | 0.038 | 0.005 | 10.70 | <0.001 | 0.90 | 0.04 | 0.0190 | <0.001 | 0.010 | <0.001 | <0.001 | <0.001 | <0.0001 | 0.480 | 0.490 | 0.0045 |
| 17 | 0.0195 | 1.98 | 2.00 | 0.001 | <0.001 | 9.66 | 0.310 | 0.01 | 2.98 | 0.0210 | <0.001 | 0.010 | <0.001 | <0.001 | <0.001 | <0.0001 | 0.080 | 0.050 | 0.0030 |
| 18 | 0.0088 | 0.18 | 2.50 | 0.020 | 0.005 | 11.50 | 2.910 | 1.50 | 1.50 | 0.0111 | <0.001 | 0.010 | <0.001 | <0.001 | <0.001 | <0.0001 | 0.038 | 0.050 | 0.0070 |
| 19 | 0.0100 | 0.20 | 0.51 | 0.020 | 0.005 | 11.40 | 0.350 | 0.91 | 1.50 | 0.0100 | <0.001 | 0.110 | <0.001 | <0.001 | <0.001 | <0.0001 | 0.080 | 0.030 | 0.0050 |
| 20 | 0.0085 | 0.20 | 0.69 | 0.022 | 0.004 | 11.50 | <0.001 | 0.51 | 0.50 | 0.0120 | 0.630 | 0.010 | <0.001 | <0.001 | <0.001 | <0.0001 | 0.011 | 0.200 | 0.0080 |
| 21 | 0.0130 | 0.20 | 1.50 | 0.021 | 0.005 | 11.02 | 0.050 | 0.51 | 0.31 | 0.0120 | 0.030 | 0.010 | <0.001 | <0.001 | 0.510 | <0.0001 | 0.023 | 0.150 | 0.0050 |
| 22 | 0.0080 | 0.21 | 0.88 | 0.002 | 0.004 | 11.01 | 1.000 | 0.44 | 0.80 | 0.0100 | <0.001 | 0.008 | <0.001 | <0.001 | 0.002 | <0.0001 | 0.015 | 0.100 | 0.0050 |
| 23 | 0.0120 | 0.20 | 0.77 | 0.002 | 0.004 | 11.82 | 0.010 | 0.50 | 0.25 | 0.0095 | 0.020 | 0.008 | <0.001 | <0.001 | <0.001 | 0.0002 | 0.021 | 0.110 | 0.0050 |
| 24 | 0.0056 | 0.18 | 0.78 | 0.022 | 0.005 | 11.68 | 0.010 | 0.30 | 0.01 | 0.0088 | 0.060 | 0.009 | <0.001 | <0.001 | 0.003 | 0.0019 | 0.011 | 0.050 | 0.0050 |
| 25 | 0.0088 | 0.21 | 0.80 | 0.022 | 0.005 | 11.75 | 0.002 | 0.30 | 0.05 | 0.0110 | <0.001 | 0.006 | 0.20 | 0.20 | 0.003 | <0.0001 | 0.030 | 0.050 | 0.0050 |
| 26 | 0.0095 | 0.19 | 0.88 | 0.022 | 0.005 | 9.84 | <0.001 | 0.51 | 0.80 | 0.0120 | <0.001 | 0.350 | 0.68 | <0.001 | <0.001 | 0.0003 | 0.070 | 0.050 | 0.0050 |
| 27 | 0.0110 | 0.21 | 0.82 | 0.028 | 0.005 | 11.90 | 0.002 | 0.51 | 0.05 | 0.0100 | <0.001 | 0.008 | <0.001 | 0.480 | <0.001 | <0.0001 | 0.050 | 0.050 | 0.0050 |
| 28 | 0.0099 | 0.21 | 0.81 | 0.021 | 0.005 | 11.50 | 0.002 | 0.48 | 0.05 | 0.0110 | <0.001 | 0.008 | <0.001 | <0.001 | <0.001 | <0.0001 | 0.008 | 0.200 | 0.0004 |
| 29 | 0.0088 | 0.18 | 0.80 | 0.021 | 0.005 | 11.50 | 0.002 | 0.50 | 0.04 | 0.0120 | <0.001 | 0.008 | <0.001 | <0.001 | <0.001 | <0.0001 | 0.110 | 0.001 | 0.0008 |
| 30 | 0.0089 | 0.19 | 0.82 | 0.021 | 0.005 | 11.50 | 0.002 | 0.48 | 0.05 | 0.0099 | <0.001 | 0.008 | <0.001 | <0.001 | <0.001 | <0.0001 | 0.001 | 0.110 | 0.0010 |
| 31 | 0.0067 | 0.22 | 0.11 | 0.030 | 0.006 | 11.06 | <0.001 | 0.30 | <0.01 | 0.0118 | <0.001 | 0.006 | <0001 | <0.001 | <0.001 | <0.0001 | 0.050 | 0.061 | 0.0055 |
| 32 | 0.0061 | 0.25 | 0.42 | 0.028 | 0.005 | 11.10 | <0.001 | 0.42 | <0.01 | 0.0120 | <0.001 | 0.001 | <0.001 | <0.001 | <0.001 | <0.0001 | 0.062 | 0.044 | 0.0060 |
| 33 | 0.0080 | 0.20 | 0.31 | 0.031 | 0.008 | 9.05 | <0.001 | 0.31 | 0.30 | 0.0102 | <0.001 | 0.007 | <0.001 | <0.001 | <0.001 | <0.0001 | 0.105 | 0.054 | 0.0042 |
| 34 | 0.0155 | 0.15 | 1.01 | 0.020 | 0.004 | 11.05 | <0.001 | 0.51 | <0.01 | 0.0120 | 0.082 | 0.008 | <0.001 | <0.001 | <0.001 | <0.0001 | 0.052 | 0.060 | 0.0046 |
| 35 | 0.0150 | 0.18 | 0.95 | 0.025 | 0.005 | 10.80 | <0.001 | 0.55 | <0.01 | 0.0114 | <0.001 | 0.008 | <0.001 | <0.001 | 0.081 | <0.0001 | 0.060 | 0.070 | 0.0054 |
| 36 | 0.0098 | 0.21 | 0.50 | 0.030 | 0.006 | 11.22 | 0.545 | 1.10 | <0.01 | 0.0110 | <0.001 | 0.010 | <0.001 | <0.001 | <0.001 | <0.0001 | 0.081 | 0.051 | 0.0052 |
| 37 | 0.0097 | 0.20 | 0.80 | 0.024 | 0.005 | 8.20 | <0.001 | 0.47 | <0.01 | 0.0121 | <0.001 | 0.010 | <0.001 | <0.001 | <0.001 | 0.0005 | 0.075 | 0.066 | 0.0051 |

TABLE 2

| No. | X value | C/N | Z value | Remarks |
|---|---|---|---|---|
| 1 | 6.89 | 0.83 | 0.151 | Example |
| 2 | 9.38 | 0.98 | 0.152 | Example |
| 3 | 10.58 | 0.64 | 0.130 | Example |
| 4 | 11.24 | 0.82 | 0.089 | Comp. Example |
| 5 | 12.48 | 0.94 | 0.091 | Comp. Example |
| 6 | 14.35 | 3.96 | 0.089 | Comp. Example |
| 7 | 6.92 | 1.03 | 0.304 | Example |
| 8 | 9.45 | 1.00 | 0.128 | Example |
| 9 | 10.55 | 0.98 | 0.024 | Comp. Example |
| 10 | 10.30 | 0.89 | 0.045 | Example |
| 11 | 10.29 | 2.90 | 0.152 | Example |
| 12 | 10.24 | 1.36 | 0.351 | Example |
| 13 | 10.10 | 0.96 | 0.788 | Example |
| 14 | 10.91 | 2.25 | 1.666 | Comp. Example |
| 15 | 11.09 | 2.23 | 1.869 | Comp. Example |
| 16 | 10.10 | 0.68 | 1.232 | Example |
| 17 | 9.29 | 0.93 | 0.184 | Example |
| 18 | 10.64 | 0.79 | 0.141 | Example |

TABLE 2-continued

| No. | X value | C/N | Z value | Remarks |
|---|---|---|---|---|
| 19 | 10.41 | 1.00 | 0.174 | Example |
| 20 | 10.04 | 0.71 | 0.255 | Example |
| 21 | 9.46 | 1.08 | 0.209 | Example |
| 22 | 10.51 | 0.80 | 0.147 | Example |
| 23 | 10.48 | 1.26 | 0.166 | Example |
| 24 | 10.88 | 0.64 | 0.091 | Example |
| 25 | 10.78 | 0.80 | 0.119 | Example |
| 26 | 10.92 | 0.79 | 0.179 | Example |
| 27 | 10.69 | 1.10 | 0.149 | Example |
| 28 | 10.23 | 0.90 | 0.214 | Comp. Example |
| 29 | 10.31 | 0.73 | 0.170 | Comp. Example |
| 30 | 10.31 | 0.90 | 0.116 | Comp. Example |
| 31 | 10.50 | 0.57 | 0.162 | Example |
| 32 | 10.30 | 0.51 | 0.166 | Example |
| 33 | 8.23 | 0.78 | 0.232 | Example |
| 34 | 9.47 | 1.29 | 0.160 | Example |
| 35 | 9.33 | 1.32 | 0.186 | Example |
| 36 | 10.17 | 0.89 | 0.197 | Example |
| 37 | 7.03 | 0.80 | 0.203 | Example |

TABLE 3

| | Composition for ingredients (mass %) | | | | | | | | | | | |
|---|---|---|---|---|---|---|---|---|---|---|---|---|
| No. | C | Si | Mn | P | S | Cr | Mo | Ni | Cu | N | Al | B |
| 38 | 0.0028 | 0.20 | 0.64 | 0.020 | 0.005 | 8.05 | <0.001 | 0.50 | 0.05 | 0.0051 | 0.010 | <0.0001 |
| 39 | 0.0036 | 0.19 | 0.60 | 0.025 | 0.004 | 8.51 | <0.001 | 0.50 | 0.05 | 0.0039 | 0.010 | <0.0001 |
| 40 | 0.0050 | 0.18 | 0.61 | 0.022 | 0.005 | 8.44 | <0.001 | 0.51 | 0.05 | 0.0030 | 0.010 | <0.0001 |
| 41 | 0.0050 | 0.20 | 0.80 | 0.020 | 0.005 | 11.50 | <0.001 | 0.50 | 0.02 | 0.0155 | 0.010 | <0.0001 |
| 42 | 0.0097 | 0.20 | 0.51 | 0.028 | 0.005 | 11.66 | <0.001 | 0.50 | 0.05 | 0.0090 | 0.009 | <0.0001 |
| 43 | 0.0070 | 0.20 | 1.41 | 0.020 | 0.005 | 14.55 | <0.001 | 2.90 | 1.00 | 0.0130 | 0.010 | <0.0001 |
| 44 | 0.0130 | 0.17 | 1.44 | 0.024 | 0.005 | 14.90 | <0.001 | 2.89 | 1.01 | 0.0071 | 0.008 | <0.0001 |
| 45 | 0.0070 | 0.20 | 0.79 | 0.020 | 0.005 | 13.80 | <0.001 | 0.50 | 0.05 | 0.0130 | 0.010 | <0.0001 |
| 46 | 0.0033 | 0.20 | 0.80 | 0.020 | 0.005 | 14.10 | <0.001 | <0.01 | 0.06 | 0.0150 | 0.009 | <0.0001 |
| 47 | 0.0164 | 0.20 | 0.80 | 0.020 | 0.005 | 11.80 | 0.003 | 0.50 | 0.05 | 0.0291 | 0.010 | <0.0001 |
| 48 | 0.0110 | 0.20 | 2.94 | 0.030 | 0.028 | 11.70 | <0.001 | 0.50 | 0.04 | 0.0230 | 0.011 | <0.0001 |
| 49 | 0.0090 | 0.19 | 0.79 | 0.020 | 0.004 | 11.50 | 1.010 | 0.50 | 0.05 | 0.0210 | 0.010 | <0.0001 |
| 50 | 0.0078 | 0.18 | 0.80 | 0.020 | 0.005 | 8.20 | 2.950 | 0.91 | 1.33 | 0.0131 | 0.010 | <0.0001 |
| 51 | 0.0080 | 0.20 | 0.78 | 0.020 | 0.005 | 11.40 | <0.001 | 0.05 | 2.91 | 0.0201 | 0.010 | 0.0002 |
| 52 | 0.0085 | 0.20 | 0.69 | 0.022 | 0.004 | 11.80 | <0.001 | 0.25 | 0.50 | 0.0180 | 0.010 | 0.0019 |
| 53 | 0.0050 | 0.20 | 0.80 | 0.021 | 0.005 | 16.20 | 3.320 | 0.51 | 3.31 | 0.0150 | 0.010 | <0.0001 |
| 54 | 0.0070 | 0.24 | 0.30 | 0.030 | 0.005 | 9.06 | <0.001 | 0.40 | 0.30 | 0.0131 | 0.008 | <0.0001 |
| 55 | 0.0050 | 0.22 | 0.12 | 0.022 | 0.005 | 11.02 | <0.001 | 0.35 | <0.01 | 0.0122 | 0.006 | <0.0001 |

| | Composition for ingredients (mass %) | | | | | | |
|---|---|---|---|---|---|---|---|
| No. | V | Co | W | X value | C/N | Z value | Remarks |
| 38 | 0.010 | 0.020 | 0.0070 | 7.34 | 0.55 | 0.069 | Example |
| 39 | 0.025 | 0.021 | 0.0020 | 7.82 | 0.92 | 0.068 | Example |
| 40 | 0.042 | 0.020 | 0.0031 | 7.71 | 1.67 | 0.098 | Example |
| 41 | 0.010 | 0.020 | 0.0020 | 10.35 | 0.32 | 0.045 | Example |
| 42 | 0.081 | 0.020 | 0.0022 | 10.70 | 1.08 | 0.152 | Example |
| 43 | 0.010 | 0.020 | 0.0020 | 10.22 | 0.54 | 0.045 | Example |
| 44 | 0.011 | 0.020 | 0.0031 | 10.81 | 1.83 | 0.051 | Example |
| 45 | 0.010 | 0.004 | 0.0020 | 12.66 | 0.54 | 0.029 | Comp. Example |
| 46 | 0.311 | 0.020 | 0.0020 | 13.54 | 0.22 | 0.496 | Comp. Example |
| 47 | 0.161 | 0.050 | 0.0080 | 9.90 | 0.56 | 0.330 | Example |
| 48 | 0.480 | 0.010 | 0.0010 | 9.17 | 0.48 | 0.735 | Example |
| 49 | 0.011 | 0.490 | 0.0010 | 10.76 | 0.43 | 0.511 | Example |
| 50 | 0.038 | 0.100 | 0.0440 | 8.86 | 0.60 | 0.368 | Example |

TABLE 3-continued

| | | | | | | | |
|---|---|---|---|---|---|---|---|
| 51 | 0.030 | 0.110 | 0.0080 | 8.98 | 0.40 | 0.193 | Example |
| 52 | 0.021 | 0.130 | 0.0020 | 10.47 | 0.47 | 0.171 | Example |
| 53 | 0.023 | 0.080 | 0.0100 | 16.69 | 0.33 | 0.163 | Comp. Example |
| 54 | 0.044 | 0.032 | 0.0051 | 8.17 | 0.53 | 0.122 | Example |
| 55 | 0.051 | 0.023 | 0.0031 | 10.47 | 0.41 | 0.114 | Example |

TABLE 4

| | Base material characteristic | | | | Weld joint characteristic | | | | | | | |
|---|---|---|---|---|---|---|---|---|---|---|---|---|
| | Tensile characteristic | | | Impact toughness | Max. | Heat-affected zone toughness (5.0 mm thickness) | | Bending characteristic (bending at 180° C.) | | | Initial rusting resistance (SST) Number of initial rust (Number/ | |
| No. | Yield stress (MPa) | Tensile strength (MPa) | Elongation (%) | Transition temperature (%) | hardness Hv (0.5 kg) | 20° C. absorption energy (J/cm$^2$) | Transition temperature (° C.) | 2.0 mm thickness | 5.0 mm thickness | 8.0 mm thickness | bead 10 cm) | Remark |
| 1 | 305 | 430 | 32 | −95 | 273 | 230 | −40 | ○ | ○ | ○ | 25 | Example |
| 2 | 303 | 425 | 32 | −90 | 270 | 225 | −40 | ○ | ○ | ○ | 25 | Example |
| 3 | 298 | 420 | 32 | −90 | 271 | 210 | −40 | ○ | ○ | ○ | 20 | Example |
| 4 | 277 | 390 | 33 | −45 | 150 | 130 | −5 | ○ | ○ | x | 18 | Comp. Example |
| 5 | 270 | 375 | 33 | −45 | 140 | 113 | ○ | ○ | x | x | 15 | Comp. Example |
| 6 | 265 | 368 | 33 | −40 | 130 | 95 | 5 | x | x | x | 18 | Comp. Example |
| 7 | 341 | 480 | 29 | −80 | 235 | 225 | −45 | ○ | ○ | ○ | 38 | Example |
| 8 | 280 | 380 | 36 | −110 | 250 | 210 | −50 | ○ | ○ | ○ | 3 | Example |
| 9 | 310 | 428 | 33 | −90 | 283 | 230 | −45 | ○ | ○ | ○ | 88 | Comp. Example |
| 10 | 300 | 425 | 30 | −95 | 270 | 231 | −45 | ○ | ○ | ○ | 38 | Example |
| 11 | 300 | 415 | 33 | −95 | 268 | 225 | −40 | ○ | ○ | ○ | 15 | Example |
| 12 | 321 | 445 | 31 | −90 | 278 | 233 | −40 | ○ | ○ | ○ | 10 | Example |
| 13 | 320 | 430 | 32 | −90 | 273 | 230 | −40 | ○ | ○ | ○ | 11 | Example |
| 14 | 400 | 530 | 23 | −65 | 270 | 160 | −10 | ○ | x | x | 16 | Comp. Example |
| 15 | 440 | 580 | 22 | −60 | 199 | 100 | −20 | x | x | x | 21 | Comp. Example |
| 16 | 330 | 431 | 32 | −90 | 273 | 220 | −40 | ○ | ○ | ○ | 13 | Example |
| 17 | 310 | 410 | 30 | −85 | 315 | 210 | −35 | ○ | ○ | ○ | 15 | Example |
| 18 | 330 | 450 | 31 | −85 | 300 | 220 | −45 | ○ | ○ | ○ | 10 | Example |
| 19 | 303 | 410 | 32 | −85 | 270 | 230 | −40 | ○ | ○ | ○ | 12 | Example |
| 20 | 305 | 420 | 33 | −95 | 263 | 220 | −35 | ○ | ○ | ○ | 10 | Example |
| 21 | 310 | 421 | 31 | −85 | 255 | 210 | −35 | ○ | ○ | ○ | 8 | Example |
| 22 | 300 | 410 | 31 | −85 | 280 | 235 | −45 | ○ | ○ | ○ | 5 | Example |
| 23 | 300 | 420 | 32 | −90 | 270 | 220 | −40 | ○ | ○ | ○ | 10 | Example |
| 24 | 310 | 440 | 31 | −85 | 270 | 230 | −40 | ○ | ○ | ○ | 10 | Example |
| 25 | 308 | 420 | 33 | −90 | 260 | 220 | −40 | ○ | ○ | ○ | 15 | Example |
| 26 | 310 | 410 | 31 | −80 | 270 | 220 | −35 | ○ | ○ | ○ | 13 | Example |
| 27 | 308 | 403 | 32 | −85 | 270 | 220 | −40 | ○ | ○ | ○ | 15 | Example |
| 28 | 303 | 420 | 33 | −85 | 280 | 235 | −40 | ○ | ○ | ○ | 65 | Comp. Example |
| 29 | 305 | 415 | 33 | −85 | 265 | 230 | −40 | ○ | ○ | ○ | 60 | Comp. Example |
| 30 | 307 | 420 | 33 | −85 | 273 | 235 | −40 | ○ | ○ | ○ | 71 | Comp. Example |
| 31 | 288 | 410 | 37 | −100 | 253 | 240 | −60 | ○ | ○ | ○ | 15 | Example |
| 32 | 292 | 414 | 36 | −100 | 263 | 250 | −60 | ○ | ○ | ○ | 20 | Example |
| 33 | 286 | 405 | 35 | −85 | 255 | 210 | −40 | ○ | ○ | ○ | 18 | Example |
| 34 | 320 | 440 | 32 | −90 | 253 | 215 | −35 | ○ | ○ | ○ | 25 | Example |
| 35 | 319 | 442 | 31 | −90 | 255 | 215 | −35 | ○ | ○ | ○ | 24 | Example |
| 36 | 315 | 440 | 31 | −85 | 270 | 220 | −40 | ○ | ○ | ○ | 23 | Example |
| 37 | 302 | 424 | 33 | −95 | 270 | 220 | −40 | ○ | ○ | ○ | 24 | Example |

○: no cracks
x: cracked

TABLE 5

| Steel No. | Base material with scale Number of rust (N/10 cm$^2$) | Base material with scale Corrosion pit depth (Average of maximum 10 points μm) | Number of rust in weld zone (Number/bead 10 cm) | Corrosion pit depth in weld zone in along bead 10 cm (Average of maximum 10 points μm) | Remark |
|---|---|---|---|---|---|
| 9 | 128 | 125 | 88 | 88 | Comp. Example |
| 10 | 63 | 65 | 38 | 35 | Example |
| 11 | 60 | 55 | 15 | 34 | Example |
| 12 | 55 | 48 | 10 | 26 | Example |
| 13 | 53 | 48 | 11 | 25 | Example |
| 28 | 89 | 88 | 76 | 65 | Comp. Example |
| 29 | 95 | 90 | 72 | 60 | Comp. Example |
| 30 | 100 | 95 | 77 | 71 | Comp. Example |

*Steel No. corresponding to steels in Table 1

TABLE 6

| | Base material characteristic | | Weld joint characteristic | | | | | |
|---|---|---|---|---|---|---|---|---|
| | Tensile characteristic | Impact toughness | Heat-affected zone toughness (5.0 mm thickness) | | Bending characteristic (bending at 180°) | | | |
| No. | Elongation (%) | Transition temperature (° C.) | 20° C. absorption energy (J/cm$^2$) | Transition temperature (° C.) | 5.0 mm thickness | 8.0 mm thickness | 12.0 mm thickness | Remark |
| 38 | 39 | −105 | 260 | −60 | ○ | ○ | ○ | Example |
| 39 | 32 | −80 | 220 | −35 | ○ | ○ | x | Example |
| 40 | 30 | −80 | 200 | −35 | ○ | ○ | x | Example |
| 41 | 38 | −100 | 255 | −60 | ○ | ○ | ○ | Example |
| 42 | 30 | −85 | 208 | −40 | ○ | ○ | x | Example |
| 43 | 36 | −105 | 255 | −65 | ○ | ○ | ○ | Example |
| 44 | 28 | −85 | 180 | −40 | ○ | ○ | x | Example |
| 45 | 38 | −100 | 80 | −10 | x | x | x | Comp. Example |
| 46 | 36 | −100 | 60 | −10 | x | x | x | Comp. Example |
| 47 | 35 | −100 | 250 | −60 | ○ | ○ | ○ | Example |
| 48 | 32 | −100 | 240 | −60 | ○ | ○ | ○ | Example |
| 49 | 36 | −100 | 255 | −60 | ○ | ○ | ○ | Example |
| 50 | 34 | −100 | 239 | −60 | ○ | ○ | ○ | Example |
| 51 | 36 | −100 | 250 | −60 | ○ | ○ | ○ | Example |
| 52 | 36 | −105 | 250 | −65 | ○ | ○ | ○ | Example |
| 53 | 36 | −85 | 145 | −25 | x | x | x | Comp. Example |
| 54 | 36 | −100 | 250 | −60 | ○ | ○ | ○ | Example |
| 55 | 35 | −100 | 255 | −60 | ○ | ○ | ○ | Example |

○: no cracks
X: cracked

What is claimed is:

1. A Fe—Cr alloy having excellent initial rust resistance, workability and weldability comprising a composition of:

C: more than about 0.0025 mass % and less than about 0.03 mass %,

N: more than about 0.0025 mass % and less than about 0.03 mass %,

Si: more than about 0.1 mass % and less than about 2.0 mass %,

Mn: more than about 0.1 mass % and less than about 3.0 mass %

Cr: more than about 8.0 mass % and less than about 15 mass %,

Al: less than about 0.5 mass %,

P: less than about 0.04 mass %,

S: less than about 0.03 mass %,

Ni: from about 0.01 mass % to about 3.0 mass %,

Co: from about 0.01 mass % to about 0.5 mass %,

V: from about 0.01 mass % to about 0.5 mass % and

W: from about 0.001 mass % to about 0.05 mass %, and a X value in the following equation (1), satisfies: X≦11.0, the balance substantially being Fe and inevitable impurities:

$$X\ value = Cr(mass\ \%) + Mo(mass\ \%) + 1.5\ Si(mass\ \%) + 0.5\ Nb(mass\ \%) + 0.2V(mass\ \%) + 0.3W(mass\ \%) + 8\ Al(mass\ \%) - Ni(mass\ \%) - 0.6\ Co(mass\ \%) - 0.5\ Mn(mass\ \%) - 30\ C(mass\ \%) - 30\ N(mass\ \%) - 0.5\ Cu(mass\ \%) \quad (1).$$

2. The Fe—Cr alloy having excellent initial rust resistance, workability and weldability as defined in the claim 1, wherein a Z value represented by the following equation (2) satisfies : 0.03≦Z value≦1.5:

$$Z\ value = (Co(mass\ \%) + 1.5V(mass\ \%) + 4.8W(mass\ \%)) \quad (2).$$

3. The Fe—Cr alloy having excellent initial rust resistance, workability and weldability as defined in claim 1, wherein C/N≦0.60.

4. The Fe—Cr alloy having excellent initial rust resistance, workability and weldability as defined in claim 1, wherein the alloy has a composition further comprising at least one element selected from:

Cu: from about 0.0001 mass % to about 3.0 mass % and

Mo: from about 0.0001 mass % to about 3.0 mass %.

5. The Fe—Cr alloy having excellent initial rust resistance, workability and weldability as defined in claim 1, wherein the alloy has a composition further comprising at least one element selected from the group consisting of:

Ti: from about 0.0001 mass % to about 0.7 mass %,

Nb: from about 0.0001 mass % to about 0.7 mass %,

Ta: from about 0.0001 mass % to about 0.7 mass % and

Zr: from about 0.0001 mass % to about 0.5 mass %.

6. The Fe—Cr alloy having excellent initial rust resistance, workability and weldability as defined in claim 1, wherein the alloy has a composition further comprising B: from about 0.0002 mass % to about 0.002 mass %.

7. The Fe—Cr alloy having excellent initial rust resistance, workability and weldability as defined in claim 2, wherein C/N $\leqq 0.60$.

8. The Fe—Cr alloy having excellent initial rust resistance, workability and weldability as claimed in claim 2, wherein the alloy has a composition further comprising at least one element selected from:

Cu: from about 0.0001 mass % to about 3.0 mass % and

Mo: from about 0.0001 mass % to about 3.0 mass %.

9. The Fe—Cr alloy having excellent initial rust resistance, workability and weldability as claimed in claim 3, wherein the alloy has a composition further comprising at least one element selected from:

Cu: from about 0.0001 mass % to about 3.0 mass % and

Mo: from about 0.0001 mass % to about 3.0 mass %.

10. The Fe—Cr alloy having excellent initial rust resistance, workability and weldability as defined in claim 2, wherein the alloy has a composition further comprising at least one element selected from the group consisting of:

Ti: from about 0.0001 mass % to about 0.7 mass %,

Nb: from about 0.0001 mass % to about 0.7 mass %,

Ta: from about 0.0001 mass % to about 0.7 mass % and

Zr: from about 0.0001 mass % to about 0.5 mass %.

11. The Fe—Cr alloy having excellent initial rust resistance, workability and weldability as defined in claim 3, wherein the alloy has a composition further comprising at least one element selected from the group consisting of:

Ti: from about 0.0001 mass % to about 0.7 mass %,

Nb: from about 0.0001 mass % to about 0.7 mass %,

Ta: from about 0.0001 mass % to about 0.7 mass % and

Zr: from about 0.0001 mass % to about 0.5 mass %.

12. The Fe—Cr alloy having excellent initial rust resistance, workability and weldability as defined in claim 4, wherein the alloy has a composition further comprising at least one element selected from the group consisting of:

Ti: from about 0.0001 mass % to about 0.7 mass %,

Nb: from about 0.0001 mass % to about 0.7 mass %,

Ta: from about 0.0001 mass % to about 0.7 mass % and

Zr: from about 0.0001 mass % to about 0.5 mass %.

13. The Fe—Cr alloy having excellent initial rust resistance, workability and weldability as defined in claim 2, wherein the alloy has a composition further comprising B: from about 0.0002 mass % to about 0.002 mass %.

14. The Fe—Cr alloy having excellent initial rust resistance, workability and weldability as defined in claim 3, wherein the alloy has a composition further comprising B: from about 0.0002 mass % to about 0.002 mass %.

15. The Fe—Cr alloy having excellent initial rust resistance, workability and weldability as defined in claim 4, wherein the alloy has a composition further comprising B: from about 0.0002 mass % to about 0.002 mass %.

16. The Fe—Cr alloy having excellent initial rust resistance, workability and weldability as defined in claim 5, wherein the alloy has a composition further comprising B: from about 0.0002 mass % to about 0.002 mass %.

* * * * *